US006556512B1

(12) United States Patent
Winkler

(10) Patent No.: US 6,556,512 B1
(45) Date of Patent: Apr. 29, 2003

(54) MOBILE TERMINAL FOR A WIRELESS TELECOMMUNICATION SYSTEM WITH ACCURATE REAL TIME GENERATION

(75) Inventor: Gregor Winkler, Zorneding (DE)

(73) Assignee: Sony International (Europe) GmbH, Berlin (DE)

( * ) Notice: Subject to any disclaimer, the term of this patent is extended or adjusted under 35 U.S.C. 154(b) by 0 days.

(21) Appl. No.: 09/691,408

(22) Filed: Oct. 18, 2000

(30) Foreign Application Priority Data

Oct. 20, 1999 (EP) ..... 99120778

(51) Int. Cl.[7] ..... G04C 11/02

(52) U.S. Cl. ..... 368/47; 368/46; 368/155

(58) Field of Search ..... 368/47, 155, 187, 368/200, 202, 46; 455/575, 38.1; 375/355; 370/498; 340/309.4

(56) References Cited

U.S. PATENT DOCUMENTS

| | | | | | |
|---|---|---|---|---|---|
| 4,117,661 | A | * | 10/1978 | Bryant, Jr. | 368/47 |
| 4,264,967 | A | * | 4/1981 | Fujita et al. | 368/200 |
| 4,315,332 | A | * | 2/1982 | Sakami et al. | 368/47 |
| 4,582,434 | A | * | 4/1986 | Plangger et al. | 368/47 |
| 5,274,545 | A | * | 12/1993 | Allan et al. | 368/202 |
| 5,363,377 | A | * | 11/1994 | Sharpe | 368/47 |
| 5,416,435 | A | * | 5/1995 | Jokinen et al. | 327/113 |
| 5,469,411 | A | | 11/1995 | Owen | |
| 5,546,363 | A | * | 8/1996 | Funaki et al. | 368/200 |
| 5,590,092 | A | * | 12/1996 | Fehnel | 368/47 |
| 5,621,703 | A | * | 4/1997 | Kanesaka | 368/47 |
| 5,717,661 | A | * | 2/1998 | Poulson | 368/202 |
| 5,719,827 | A | * | 2/1998 | Diep et al. | 368/47 |
| 5,739,762 | A | * | 4/1998 | Kuramatsu et al. | 455/38.1 |
| 5,748,570 | A | * | 5/1998 | Komoda | 368/202 |
| 5,953,648 | A | * | 9/1999 | Hutchison, IV et al. | 455/343 |
| 6,011,955 | A | * | 1/2000 | Tsuchiyama | 445/38.4 |
| 6,044,282 | A | * | 3/2000 | Hlasny | 455/574 |
| 6,088,602 | A | * | 7/2000 | Banister | 455/574 |
| 6,146,011 | A | * | 11/2000 | Owai | 368/202 |
| 6,219,564 | B1 | * | 4/2001 | Grayson et al. | 455/574 |
| 6,252,826 | B1 | * | 6/2001 | Kaizu et al. | 368/200 |
| 6,282,431 | B1 | * | 8/2001 | Konno | 368/47 |
| 6,304,517 | B1 | * | 10/2001 | Ledfelt et al. | 368/200 |
| 6,312,153 | B1 | * | 11/2001 | Okada | 368/202 |

FOREIGN PATENT DOCUMENTS

| | | |
|---|---|---|
| EP | 0 726 508 | 8/1996 |
| GB | 2 100 890 | 1/1983 |

* cited by examiner

*Primary Examiner*—Vit Miska
*Assistant Examiner*—Jeanne-Marguerite Goodwin
(74) *Attorney, Agent, or Firm*—Frommer Lawrence & Haug LLP; William S. Frommer

(57) ABSTRACT

The present invention relates to a mobile terminal (1) for a wireless telecommunication system and a method providing accurate real time information in such a mobile terminal (1). The mobile terminal (1) comprises input means (3) for inputting basic time information ($T_0$), memory means (4) for storing basic time information ($T_0$) input via said input means (3), real time means (2, 5) for continuously providing real time information ($T_x$) on the basis of low frequency oscillation signal and said basic time information ($T_0$), and processing means (5) for computing a correction value (K) for correcting said real time information $T_x$ to obtain an accurate real time information ($T_{acc}$) on the basis of an accurate time difference between a first accurate time information ($T_1$) and a second accurate time information ($T_2$) and a real time difference between a first real time information ($T_{x1}$) and a second real information ($T_{x2}$) from said real time means (2, 5).

20 Claims, 3 Drawing Sheets

MOBILE TERMINAL FOR A WIRELESS TELECOMMUNICATION SYSTEM WITH ACCURATE REAL TIME GENERATION

The present invention relates to a mobile terminal for a wireless telecommunication system with an accurate real time generation and a method for providing an accurate real time information in a mobile terminal for a wireless telecommunication system. Particularly, the present invention relates to a mobile terminal comprising a real time means providing real time information on the basis of a low frequency oscillation signal.

SUMMARY OF THE INVENTION

Mobile terminals for wireless telecommunication systems comprising real time means providing real time information on the basis of a low frequency oscillation signal are known in many different variations. For example, real time means can be quartz devices operating in the low frequency range of e.g. several kHz. Such devices usually have an accuracy of only 50 ppm, which leads to an inaccuracy of 130 seconds per month. On the other hand, these quartz devices are cheap and consume very little energy compared to highly accurate time base systems. The high inaccuracy, however, is not acceptable for consumer applications. In order to improve the accuracy normally either selected quartz devices are used or the frequency offset is measured during the manufacturing process and stored in the system. During normal operation this offset is used to compensate the frequency error.

Both above-mentioned approaches are cost-intensive. The use of selected quartz devices raises the cost of the parts of the mobile terminal, whereas measuring the offset during the manufacturing process requires additional test equipment and test time during the manufacturing. Further, both solutions are not able to cope with the aging of the real time means over time, i.e. the changement of the frequency the quartz device due to aging of the material.

U.S. Pat. No. 5,274,545 proposes a device and a method for providing accurate time and/or frequency information. A low frequency oscillator unit provides real time information which is corrected by means of an external high precision clock signal. The external clock signal is thereby used to update the real time information provided by the internal oscillator unit by means of a feedback loop.

EP 0 726 508 A1 discloses a real time clock for a mobile telephone. The real time clock signals are adjusted in response to a calibration value, whereby the calibration value is calculated depending on external clock signals received from a base station. The calibration value is thereby used to accelerate or slow down the real time clock in order to provide adjusted and accurate real time values.

EP 0 683 443 A2 discloses an electric clock comprising a usual oscillator, as e.g. a quartz oscillator, and a more accurate oscillator. The more accurate oscillator is used as a reference, to which the frequency of the usual oscillator is compared, in order to correct the oscillation frequency of the usual oscillator and to provide an accurate real time information.

EP 0 586 256 A2 discloses a time measurement system in which a slower clock oscillator and a faster clock oscillator are compared to measure the momentary error of the slower clock oscillator. Thereby, the slower clock oscillator and the faster clock oscillator are selectively coupled to a counter means to count the pulses thereof in order to provide an accurate time output.

All above-mentioned time systems are complicated and cost-intensive and therefore not suitable for application in a mobile terminal of a wireless telecommunication system. Further, the above systems are not able to cope with the aging problem in an efficient way.

The object of the present invention is therefore to provide a mobile terminal for a wireless telecommunication system and a method for providing accurate real time information in a mobile terminal of a wireless telecommunication system, in which real time information on the basis of a low frequency oscillation signal within said mobile terminal can be provided in a simple and cost-effective way, whereby particularly the aging problem can be coped with effectively.

The above object is achieved by a mobile terminal for a wireless telecommunication system comprising input means for inputting basic time information, memory means for storing basic time information input via said input means, real time means for continuously providing real time information on the basis of a low frequency oscillation signal and said stored basic time information, processing means for computing a correction value for correcting said real time information to obtain an accurate real time information on the basis of an accurate time difference between a first accurate time information and a second accurate time information and a real time difference between the first real time information and a second real time information from said real time means.

The above object is further achieved by a method for providing accurate real time information in a mobile terminal in a wireless terminal communication system comprising the steps of inputting basic time information, storing said basic time information, continuously providing real time information on the basis of a low frequency oscillation signal and said stored basic time information, and computing a correction value for correcting said real time information on the basis of an accurate time difference between a first and a second accurate time information and a real time difference between a first and a second real time information to obtain accurate real time information.

According to the present invention, a cheap and simple real time means can be implemented in a mobile terminal, whereby the inaccuracy of such a real time means can be corrected on the basis of accurate time information. Thereby, accurate real time information in a mobile terminal of a wireless telecommunication system can be provided in a simple and cost effective way. Further, the computing of a correction value for correcting the real time information to obtain an accurate real time information can be performed any time, so that particularly the aging problem can be coped with effectively.

Advantageously, the processing means of the mobile terminal calculates the correction value on the basis of a difference between the accurate time difference and the real time difference. Thereby, real time information with a high accuracy can be provided within the mobile terminal.

Further advantageously, the first and the second accurate time information are relative time information, i.e. information related and direct proportional to absolute time information. In this way, the correction of the real time information can be achieved in a simple and cost effective way since only relative accurate time information is used for computing the correction value. In this case, the mobile terminal advantageously comprises a receiving means for receiving the, first and the second accurate time information via the wireless telecommunication system. The first and the second accurate time information may for example be the frame number of transmitted GSM frames or the like. The receiving means adapted for receiving the first and the second accurate time information may be the normal receiving means of the mobile terminal for receiving control and user data in the wireless telecommunication system. Alternatively, the mobile terminal may advantageously comprise time reference means for providing the, first and the second accurate time information. Thereby, the mobile terminal may comprise a separate internal time reference means which provides a high precision time base on the basis of a high frequency oscillation signal, for example in the MHz frequency range. Normally, the high precision time base is more energy consuming than a low frequency time base, such as the real time means of the mobile terminal, so that it should not be operated continuously in the mobile terminal. Further, such a high precision time base usually does not comprise a back-up battery so that in case of power interruptions the high precision time base stops to operate.

According to a further aspect of the present invention, the second accurate time information may be input via the input means, whereby the processing means uses the basic time information as the first accurate time information for computing the correction value. The input means may in this case be the normal key pad of the mobile terminal or a separate input means especially adapted for this purpose.

In all above-mentioned aspects of the present invention, the computing means of the mobile terminal may compute the correction value only when the accurate time difference and/or the real time difference exceed a predetermined threshold value. In this case it can be avoided that the elapsed time is too short to enable a computing of an accurate correction value, e.g. when the mobile terminal is switched off, the connection is lost, or the user changes the actual time within a short period.

Further advantageously, the computing means computes the correction value automatically when a predetermined time period has elapsed since the last computation of a correction value. Hereby it can be avoided that the correction value used for correcting the real time value in the mobile terminal is not adjusted within a preset time period. It may be further advantageous if the computing means computes the correction value upon receiving a correction initialisation information. This correction initialisation information may e.g. be input by a user via the input means. Alternatively, the correction initialisation information might be received from a base station through the wireless telecommunication system. Thereby, the real time value used in the mobile terminal may be adjusted to changing time zones or summer time/winter time changes automatically.

BRIEF DESCRIPTION OF THE DRAWINGS

In the following description the preferred embodiments of the present invention are discussed in detail in relation to the enclosed drawings, in which.

DETAILED OF DESCRIPTION

Figure 1:
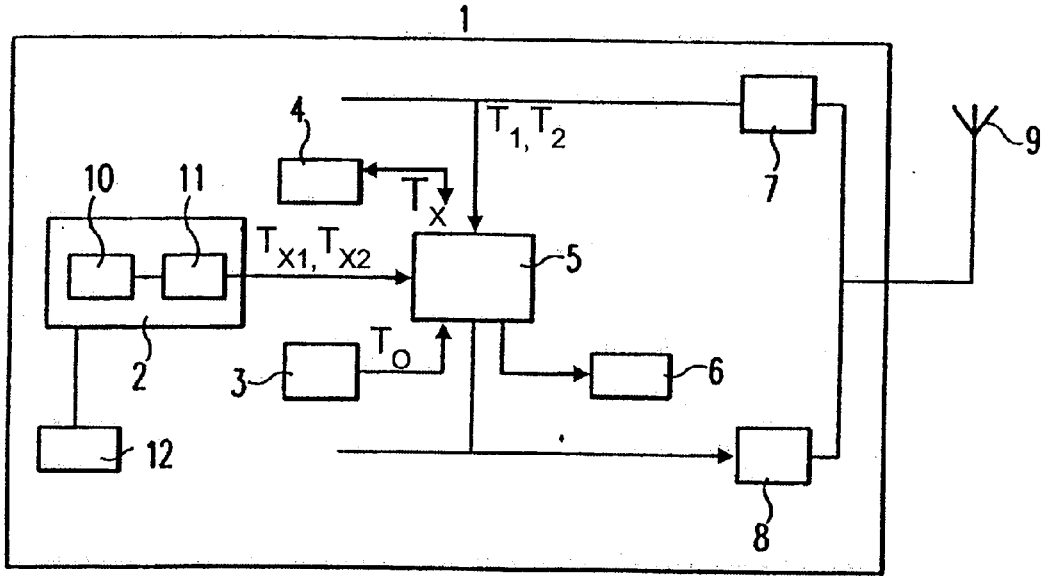
FIG. 1 shows a block diagram of a first embodiment of a mobile terminal according to a present invention.

FIG. shows a block digram of a first embodiment of a mobile terminal 1 for a wireless telecommunication system according to the present invention. The wireless telecommunication system may e.g. be a GSM system or the like, in which a base station in a cell of the telecommunication system is adapted to communicate with one or more mobile terminals.

The mobile terminal 1 of the first embodiment comprises a real time means continuously providing real time information $T_x$ on the basis of a low frequency oscillation signal. Thereby, the real time means comprises a clock means 2 consisting of a quartz device 10 which operates e.g. in the kHz frequency range and a counter 11. The low frequency oscillation signal output from the quartz device 10 is supplied to the counter 11, which transforms the low frequency oscillation signal into a counter value representing a relative time information. The clock means 2 is a cheap and low energy consuming device, which is used in the mobile terminal 1 according to the present invention to continuously provide a counter value which is transformed into a real time information. The real time information $T_x$ is generated by a processing means 5 of the mobile terminal 1, i.e. the counter value output by the clock means 2 is transformed into a real time value representing the current time point. Hereby, the processing means 5 uses basic time information $T_0$ input by an user via an input means 3 upon the start of the operation of the mobile terminal 1. The input basic time information $T_0$, which is an accurate absolute time information representing the current input time point is stored together with the respective counter value of the clock means 2 at the same time point in a memory means 4 connected to the processing means 5. This enables the processing means 5 to calculate the current real time information $T_x$ on the basis of the current counter value received from the clock means 2 and the basic time information $T_0$ and the respective counter value of the clock means 2 stored in the memory means 4.

In order not to lose the real time information when the mobile terminal 1 is switched off, the clock means 2 further comprises a back-up battery 12 connected to the quartz device 10 and the counter 11. The back-up battery 12 is charged by the rechargeable battery of the mobile terminal 1 during operation and enables the clock means 2 to maintain its operation even when the rechargeable battery of the mobile terminal 1 is taken off or empty.

The above mentioned processing computing means 5 is e.g. part of a central processing unit or a microprocessor controlling the operation of the mobile terminal 1 in the wireless telecommunication system. The input means 3 is e.g. the keypad of the mobile terminal 1. The mobile terminal 1 further comprises an output means 6, as e.g. a display. Further, the mobile terminal 1 comprises a receiving means 7 for receiving signals in the wireless communication system and a transmitting means 8 for transmitting signals in the wireless telecommunication system. The receiving means 7 and the transmitting means 8 are both connected to an antenna 9. Further, the receiving means 7 and the transmitting means 8 are connected to all further elements necessary for operating the mobile terminal 1 in the wireless telecommunication system, as e.g. coders, decoders and the like. These elements, however, are not important for the present invention and therefore not shown.

As stated above, the clock means 2 is a cheap and little energy consuming device. On the other hand, the inaccuracy of the counter value output by the clock means 2 can amount to 50 ppm, which corresponds to an inaccuracy of 130 seconds per month. According to the present invention, this inaccuracy of the clock means 2 is corrected as explained in the following. Upon the start of the operation, a user inputs a basic time information $T_0$ via the input means 3, e.g. upon switching on the mobile terminal 1 for the first time. This basic time information $T_0$ is stored in the memory means 4 together with the corresponding counter value from the clock means 2. The memory means 4 is e.g. a non-volatile memory.

The continuously increasing counter value output from the clock means 2 enables the processing means 5 to continuously calculate the real time value $T_x$ on the basis of the basic time information $T_0$ and the corresponding counter value stored in the memory means 4. At a later time point, the real time information $T_x$ provided by processing means 5 might need correction due to the inaccuracy of the clock means 2. The general idea according to the present invention is to calculate a correction value K for the real time information $T_x$ on the basis of a comparison between an accurate time difference and a real time difference. The real time difference is a difference between a first real time information $T_{x1}$ and a second real time information $T_{x2}$ calculated by the processing means 5 on the basis of the counter value's output from the clock means 2. The first real time information $T_{x1}$ and the second real time information $T_{x2}$ thereby differ by a time period which is long enough to enable the determination of the accuracy to the clock means 2. This time period may for example be several hours or several days. The accurate time difference is a time difference between a first accurate time information $T_1$ and a second $T_2$. Thereby, the first accurate time information $T_1$ is an accurate time point corresponding to the first real time information $T_{x1}$ and the second accurate time information $T_2$ is an accurate time point corresponding to the second real time information $T_{x2}$. Hereby, the first and the second accurate time information $T_1$ and $T_2$ do not need to be absolute time points, but may be relative time information so that the processing means 5 only knows precisely which time has a lapse between the first and the second time information $T_1$ and $T_2$ in order to be able to correct the real time information $T_x$.

The first and the second accurate time information $T_1$ and $T_2$ may be provided in different ways. In the first example, the first and the second accurate time information $T_1$ and $T_2$ may be received via the wireless telecommunication system by means of the receiving means 7 of the mobile terminal 1. In this case, the first and the second accurate time information $T_1$ and $T_2$ could be frame numbers of time frames used in the wireless telecommunication system. In a second example, the processing means 5 could use the basic time information $T_0$ stored in the memory means 4 as the first accurate time information $T_1$, whereby the second accurate time information $T_2$ has to be input by a user via the input means 3. In this case, the user might recognize after a certain operation time of the mobile terminal 1, that the real time information $T_x$ provided by the processing means 5 and shown on the display 6 of the mobile terminal 1 is not accurate anymore and input the accurate time as second accurate time information $T_2$. In this case, the first real time information $T_{x1}$ is the counter value corresponding to the basic time information $T_0$ stored in the memory means 4, too.

Figure 2:
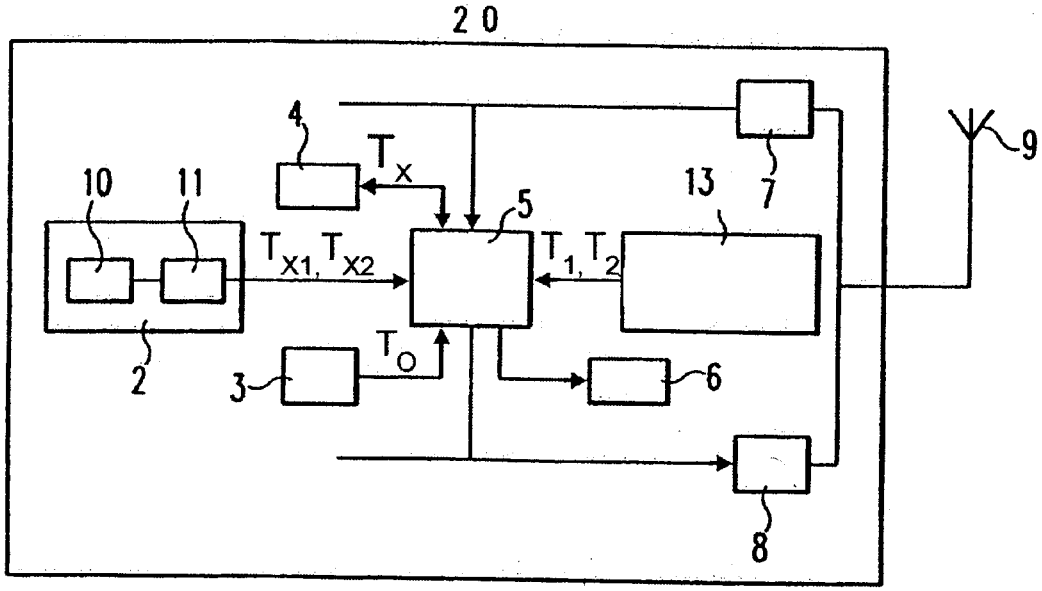
FIG. 2 shows a block diagram of a second embodiment of a mobile terminal according to the present invention, FIG. 3 a flow chart of a compensation procedure performed in a mobile terminal according to the present invention, and FIG. 4 a flow chart of a calibration or a correction procedure performed in a mobile terminal according to the present invention.

A third example of providing the accurate time difference is explained in relation to FIG. 2. FIG. 2 shows a second embodiment of a mobile terminal 20 according to the present invention. The elements of the mobile terminal 20 shown in FIG. 2 which correspond to identical elements of the mobile terminal 1 shown in FIG. 1 are identified by the same reference numerals and have the same function and features as explained in relation to FIG. 1. Further, all above explanations in relation to the mobile terminal 1 according to the first embodiment are also true for the mobile terminal 20 of the second embodiment, which the only difference that the accurate time difference is provided in the mobile terminal 20 by means of an internal time reference means 13 connected to the processing means 5. The internal time reference means 13 is a precise time reference and is for example a clock means operating on the basis of the high frequency signal. The frequency of the high frequency signal can for example be a MHz frequency range signal. This internal time reference means 13 is more energy consuming than the clock means 2 and does not have a back-up battery so that it cannot be used for continuously providing a real time base for the mobile terminal 20. However, it can be used to calculate the correction value K for correcting the real time value $T_x$ from time to time. Thereby, first accurate time information $T_1$, i.e. a first counter value output from the time reference means 13 and a second accurate time information $T_2$, i.e. a second counter value output by the time reference means 13 are supplied to the processing means 5 which calculates the difference thereof as an accurate time difference. The processing means 5 thereby uses a first real time information $T_{x1}$ from the clock means 2, i.e. a first counter value from the clock means 2 as the time point of the first counter value from the time reference means 13, and a second real time information $T_{x2}$, i.e. a second counter value at the time point of the second counter value from the time reference means 13 to calculate the real time difference.

In all above mentioned cases, the processing means calculates a correction value by calculating the difference between the accurate time difference and the real time difference, i.e. the absolute values thereof, and dividing the result by the accurate time difference, i.e. the absolute value thereof. Thus, the calculation value K is calculated by the following formula: $K=[(T_{x2}-T_{x1})-(T_2-T_1)]/(T_2-T_1)$. Then, the accurate and corrected real time value $T_{acc}$ used as the accurate time base in the mobile terminal 1 or 20 is calculated by the processing means 5 as $T_{acc}=T_0+(T_x-T_0)\times(1-K)$. Thereby, the real time information $T_x$ is calculated by the processing means 5 on the basis of the counter value corresponding to the basic time information $T_0$ stored in the memory means 4 and the current counter value output by the clock means 2. Thus, the processing means S provides an accurate real time information $T_{acc}$ for use in the mobile terminal 1. Since the calculation of the correcting value K can be repeated any time, the aging of the clock means 2 can be compensated for in an effective way. In order to ensure an effective calculation of the correction value K, the processing means S computes the correction value K only when the actual time difference and/or the real time difference exceed a predetermined threshold value. Thus, in case that the elapsed time of the system is too short to calculate an accurate correction value K, e.g. in case that the mobile terminal 1 or 20 is switched off shortly after it has been switched on, the connection is lost or the user changes the time of the mobile terminal 1 or 20 within a short period, the correction value is not calculated or the computed correction value is ignored and the calculation may be repeated. Particularly in case that the second actual time value $T_2$ is received via the wireless telecommunication system by means of the receiving means 7, the processing means 5 can compute the correction value K automatically when a predetermined time period has elapsed since the last computation of the correction value K. Additionally or alternatively, the processing means 5 may compute the correction value K upon receiving a correction initialisation information. This correction initialisation information can e.g. be input by a user via the input means 3 or received via the wireless telecommunication system. In this case, a new correction value K can automatically be calculated and used when the mobile terminal 1 or 20 changes the time zone or the summer time/winter time change is necessary. Further, the processing means 5 may compute the correction value K automatically when an additionally provided correction counter counting the number of computed correction values K reaches a predetermined number. Further, the processing means 5 may compare the correction value K with a predetermined correction threshold whereby the computed correction value K is ignored when said correction threshold is exceeded.

Figure 3:
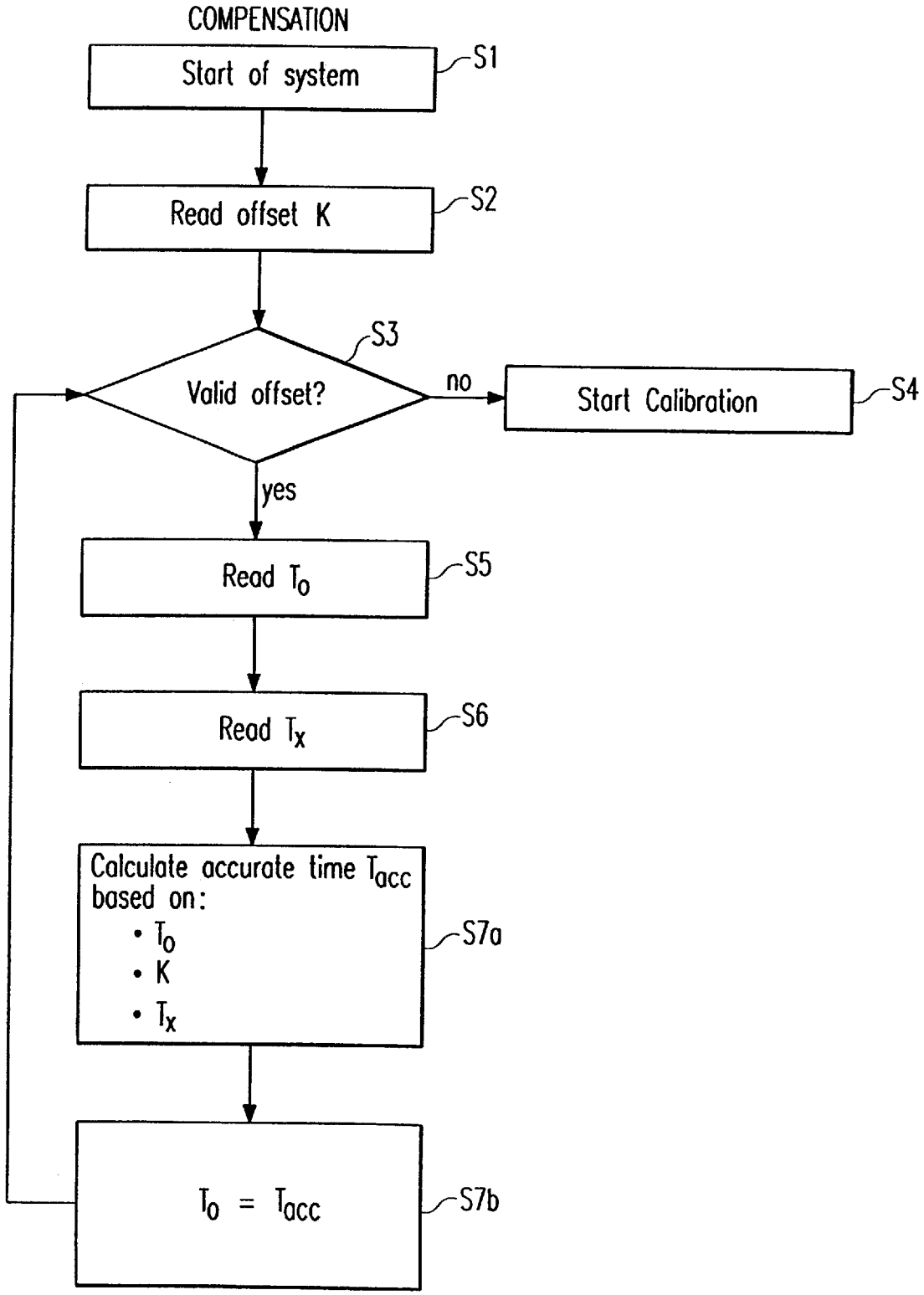

In FIG. 3, a flow chart of a compensation procedure performed in the mobile terminal 1 shown in FIG. 1 or the mobile terminal 20 shown in FIG. 2 is shown. In a first step S1, the system is started, e.g. the mobile terminal 1 or 20 is switched on by a user. In a second step S2, the correction value K stored in the memory 4 is read by the processing means 5. In a third step S3, the processing means 5 checks if the correction value K is valid or not. Thereby, it is determined if the current correction value K may still be used to calculate $T_{acc}$ or if, due to aging, temperature changes or the like, a new correction value is required. In case that the correction value K is valid, the first actual time value $T_1$ is read from the memory means 4. Then, the processing means 5 reads the actual counter value from the clock means 2 and, in a step S7*a*, calculates the accurate real time value $T_{acc}$ on the basis of the basic accurate time information $T_0$ the corresponding counter value stored in the memory means 4, the correction value K and the current counter value of the clock means 2 as explained above.

Figure 4:
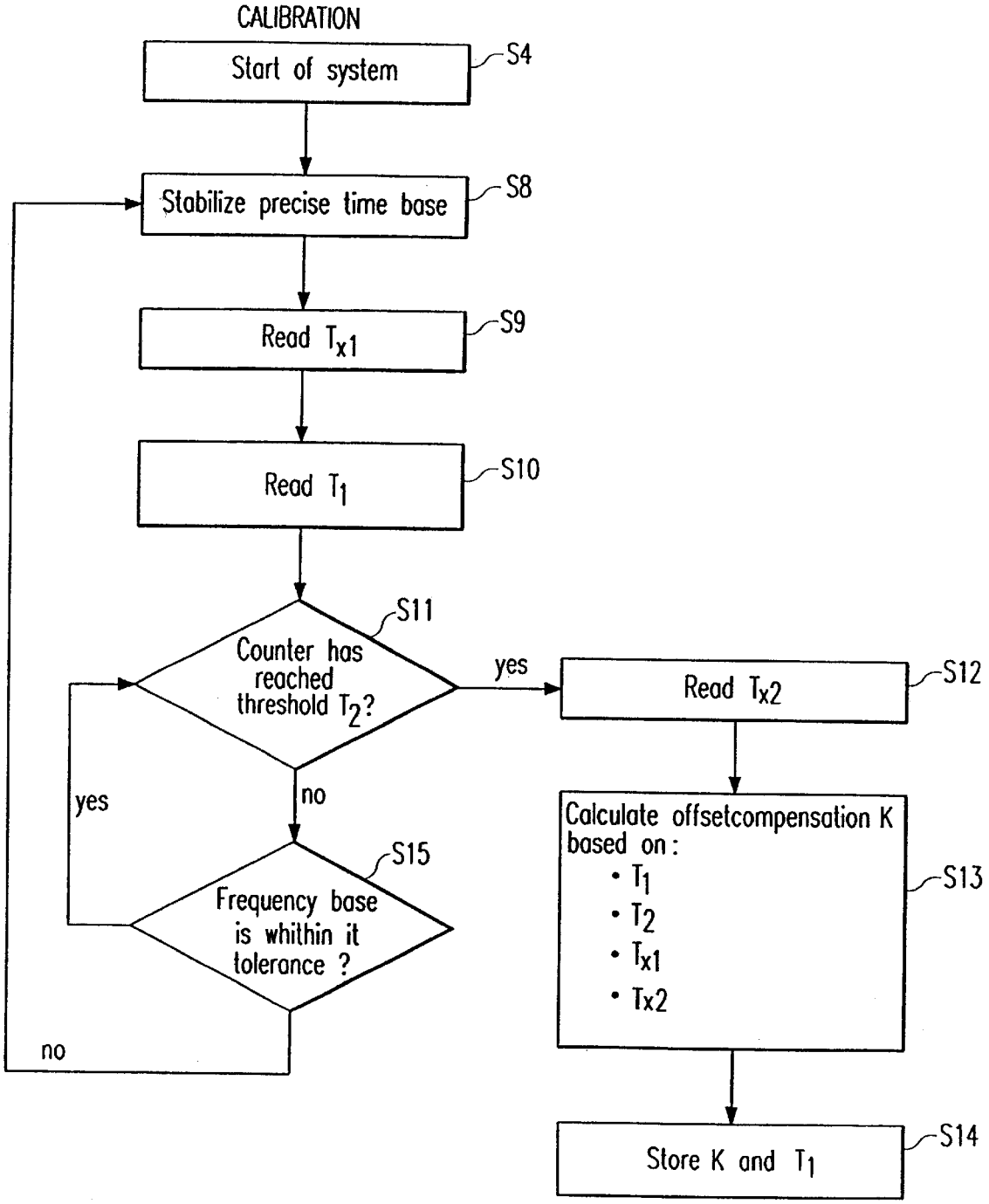

In the next step S7*b*, the calculated accurate real time value $T_{acc}$ is taken as the basic accurate time information $T_0$, whereafter the procedure goes back to step S3 and the calculation of a new accurate real time value is started. Thus, the steps S3, S5, S6, S7*a*, S7*b* are continuously repeated in the operation status of the mobile terminal, as long as the correction value K is within its limits, so that a corrected and accurate real time value $T_{acc}$ is continuously provided as a precise time base in the mobile terminal 1 or 20. By continuously repeating steps S3, S5, S6, S7*a*, S7*b*, a precise time base is provided in the mobile terminal 1 or 20 even when the correction value K is newly calibrated from time to time. In case that the computing means 5 decides in step S3 that the correction value K read from the memory 4 is not valid, the calibration or correction procedure is started in a step S4. FIG. 4 shows a flow chart of the calibration or correction procedure. The correction procedure for computing the correction value K is started upon the occurrence of one the above-mentioned cases, e.g. automatically when a predetermined time period is elapsed, upon receiving a corresponding correction initialisation information, upon deciding that the current correction value K stored in the memory means 4 is not valid or the like. Thereby, the calibration procedure shown in FIG. 4 applies to the second embodiment of the mobile terminal 20 according to the present invention shown in FIG. 2, in which an internal precise time reference means 13 for providing the first and the second accurate time information $T_1$ and $T_2$ are provided. In the first step S4 of the correction procedure, the processing means 5 starts the correction procedure upon the occurrence of one of the above-mentioned cases. In the second step S8, the internal time reference means 13 is stabilised. Then, the first real time information $T_{x1}$, i.e. the corresponding counter value is read from the clock means 2 in the next step S9. Thereafter, the first accurate time information $T_x$, i.e. the corresponding counter value from the time reference means 13 is read therefrom in a step S10. In the next step S11, the processing means 5 determines if the counter 15 of the time reference means has reached a predetermined threshold value, i.e. if a predetermined time period has elapsed. This predetermined threshold value is the second accurate time information $T_2$. In case that the processing means 5 decides that the predetermined time period has elapsed, it reads the second real time information $T_{x2}$ from the clock means 2 at the time point of the second accurate time information $T_2$. After $T_{x2}$ has been read in step S12, the processing means 5 computes the correction value K in step S13 as explained above and stores the calculated correction value K in the memory means 4.

In case that the processing means 5 decides in step 511 that the predetermined time period has not elapsed yet, it is checked in step S15 if the time reference means 13 is (still) within its tolerance. If this is the case, the procedure goes back to step 511. In case that the time frequency means 13 is not within its tolerance, the procedure goes to step S8 in which the time reference means 13 is stabilised. After the stabilisation, the steps S9 and S10 are performed as explained above.

What is claimed is:

1. Mobile terminal for a wireless telecommunication system, comprising: input means for inputting basic time information ($T_0$); memory means for storing said basic time information ($T_0$); a signal source for providing a low frequency oscillation signal; real time means for continuously providing real time information ($T_x$) on the basis of said low frequency oscillation signal and said stored basic time information ($T_0$); means for providing first ($T_{x1}$) and second ($T_{x2}$) real time information; means for providing first ($T_1$) and second ($T_2$) accurate time information; and processing means for computing a correction value (K) for correcting said real time information ($T_x$) to obtain accurate real time information ($T_{acc}$) on the basis of a time difference between said first ($T_1$) and second ($T_2$) accurate time information and a time difference between said first ($T_{x1}$) and second ($T_{x2}$) real time information.

2. Mobile terminal according to claim 1, wherein said processing means calculates said correction value (K) on the basis of a difference between said accurate time difference and said real time difference.

3. Mobile terminal according to claim 1 wherein said first and second accurate time information ($T_1$, $T_2$) are relative time information.

4. Mobile terminal according to clam 1, further including receiving means for receiving said first and second accurate time information ($T_1$, $T_2$) via the wireless telecommunication system.

5. Mobile terminal according to claim 1, further including internal time reference means for providing said first and second accurate time information ($T_1$, $T_2$).

6. Mobile terminal according to clam 1 wherein said second accurate time information ($T_2$) is input via said input means, and said processing means uses said stored basic time information ($T_0$) as said first accurate time information ($T_1$) for computing said correction value (K).

7. Mobile terminal according to claim 1 wherein said processing means computes said correction value (K) only when said accurate time difference and/or said real time difference exceed a predetermined threshold value.

8. Mobile terminal according to claim 1 wherein said processing means computes said correction value (K) automatically when a predetermined time period has elapsed since the last computation of a correction value.

9. Mobile terminal according to claim 1 wherein said processing means computes said correction value (K) upon receiving a correction initialization information.

10. Mobile terminal according to claim 1, wherein said processing means compares said correction value (K) with a predetermined correction threshold, whereby said computed correction value is ignored when it exceeds a said correction threshold.

11. Method for providing accurate real time information in a mobile terminal (1) for a wireless telecommunication system, comprising the steps of inputting basic time information ($T_0$), storing said basic time information, continuously providing real time information ($T_x$) on the basis of a low frequency oscillation signal and said stored basic time information ($T_0$), and computing a correction value (K) for correcting said real time information ($T_x$) on the basis of an accurate time difference between a first and a second accurate time information ($T_1$ and $T_2$) and a real time difference between a first and a second real time information ($T_{x1}$ and $T_{x2}$) to obtain accurate real time information ($T_{acc}$).

12. Method according to claim 11, characterized in, that said correction value (K) is calculated on the basis of a difference between said accurate time difference and said real time difference.

13. Method according to claim 11, characterized in, that said first and second accurate time information ($T_1$ and $T_2$) are relative time information.

14. Method according to claim 11, characterized in, that said first and second accurate time information ($T_1$ and $T_2$) are received via the wireless telecommunication system.

15. Method according to claim 11, characterized in, that said first and second accurate time information ($T_1$ and $T_2$) are provided within said mobile terminal.

16. Method according to claim 11, characterized by said second accurate time information ($T_2$) is input to said mobile terminal via an input means, whereby said stored basic time information ($T_0$) is used as said first accurate time information ($T_1$).

17. Method according to claim 11, characterized in, that said correction value (K) is computed only when said accurate time difference and/or said real time difference exceed a predetermined threshold value.

18. Method according to claim 11, characterized in, that said correction value (K) is computed automatically when a predetermined time period has elapsed since the last computation of a correction value.

19. Method according to claim 11, characterized in, that said correction value (K) is computed upon receiving a correction initialization information.

20. Method according to claim 11, characterized in, that said correction value (K) is compared with a predetermined correction threshold, whereby said computed correction value is ignored when it exceeds said correction threshold.

* * * * *